US006070809A

United States Patent [19]

Price

[11] Patent Number: 6,070,809

[45] Date of Patent: Jun. 6, 2000

[54] SPRAY GUN STAND AND SUPPORT

[76] Inventor: Charles Keith Price, 758 Andrews Mill Rd., Bostic, N.C. 28018

[21] Appl. No.: 09/181,224

[22] Filed: Oct. 26, 1998

[51] Int. Cl.[7] ..... B05B 15/06

[52] U.S. Cl. ..... 239/273; 239/152; 239/379; 239/526; 248/84; 248/117.2; 248/688; 222/175

[58] Field of Search ..... 239/152, 273, 239/280, 345, 379, 525, 526, 289; 248/76, 80, 82, 83, 84, 117.2, 688; 222/173, 175; 124/20.1; 42/71.02, 72

[56] References Cited

U.S. PATENT DOCUMENTS

| | | | |
|---|---|---|---|
| 396,129 | 1/1889 | Willits | 239/273 |
| 2,877,934 | 3/1959 | Wallace | 222/323 |
| 2,999,644 | 9/1961 | Nobinger | 239/229 |
| 3,262,644 | 7/1966 | Schilling et al. | 239/345 X |
| 3,648,396 | 3/1972 | Smith | 42/72 X |
| 4,250,861 | 2/1981 | Ellenburg | 124/20.1 |
| 4,735,007 | 4/1988 | Gal | 42/72 |
| 4,922,569 | 5/1990 | Brinker et al. | 15/105 |
| 4,922,884 | 5/1990 | Ford | 124/20.1 |
| 4,953,473 | 9/1990 | Tomaka et al. | 108/132 |
| 5,230,323 | 7/1993 | Saunders et al. | 124/20.1 |
| 5,236,129 | 8/1993 | Grimes et al. | 239/526 X |
| 5,255,846 | 10/1993 | Ortega | 239/273 X |
| 5,276,943 | 1/1994 | Ludy | 16/126 |

OTHER PUBLICATIONS

GF–1 Gravity–Feed Spraygun Retainer, Automotive Body Repair News, Feb. 1998 edition.

Sharpe Website printout; The Sharpe Spray Gun Holder Model 9893, believed to be prior art.

*Primary Examiner*—Andres Kashnikow
*Assistant Examiner*—Steven J. Ganey
*Attorney, Agent, or Firm*—Rhodes & Mason, PLLC

[57] ABSTRACT

A novel stand and support for gravity-fed spray guns wherein the spray gun is mounted to the present invention securely and placed in a substantially upright position. The stand is conformed to allow for the unobstructed passage of an attached air hose and further conformed to rest on the user's arm if necessary.

12 Claims, 7 Drawing Sheets

SPRAY GUN STAND AND SUPPORT

BACKGROUND OF THE INVENTION

The present invention relates generally to stands that support spray guns and more particularly to a versatile stand for gravity fed spray paint guns.

The current state of the art in the field of painting with gravity led paint guns involves using separate hangers or stands for stationing the gun when it is idle. The guns themselves are not equipped with any device for placing the gun down in a substantially upright position. Thus, separate, unattached stands are commonly used. The use of a separate stand, however, is cumbersome and inconvenient.

One method for securing the paint gun in an upright position involves the use of stands mounted to a wall. Although the stands are stable, they are often not readily accessible or convenient. Regularly, the gun needs to be set down momentarily while adjustments are made to the article being painted. For these brief periods, it is difficult and bothersome to use permanently wall-mounted stands.

While some stands are more mobile, they frequently are unstable and cumbersome. Many current stands do not support the spray gun at the base of the gun, and thus do not provide desired stability. Beyond the difficulty of instability, these stands usually require that the air hose be disassembled from the gun before the gun is placed in the stand. The spray gun usually cannot be placed in a preferred upright position without disconnecting the air hose. An upright position is preferred so a user may mix paint "on the spot" in the spray gun. This eliminates the need to travel to a mixing station. Without a mobile and stable stand to secure the spray gun upright, mixing paint is a cumbersome routine involving disconnection of the hose, transport to the mixing station and reconnection of the hose. This procedure decreases in productivity and efficiency.

Another awkward condition in the current art is the inability to support the gun should it fall from the user's hand. The gun is frequently dropped and inevitably falls to the ground sustaining damage or spilling paint. Due to the cumbersome air hose, gravity fed paint guns are not outfitted with supports to prevent the gun from filling.

SUMMARY OF THE INVENTION

The present invention is a novel spray gun stand and support. The support mounts to a gravity-fed spray gun at the base of the gun for maximum stability. The support is foldable and configured to rest upon the user's arm. Should the user drop the spray gun, it will not fall to the floor but will instead hang from the user's arm by the support. The support also has an opening through which an attached air hose can pass through unobstructed, without disconnection.

It is an object of the invention to provide a spray gun stand and support that is stable, ambulatory and does not interfere with the operation of the spray gun.

It is a further object to provide a mountable support that allows for the unobstructed passage of an air hose that is connected to the spray gun.

It is a feature of the present invention that the stand may rest upon a user's arm and support the spray gun suspended from the user's arm should the user drop the spray gun.

It is an advantage of the present invention that the spray gun may be placed upon any substantially horizontal surface for momentary idle periods, paint mixing, or substrate preparation.

DESCRIPTION OF THE PREFERRED EMBODIMENT

Figure 1:
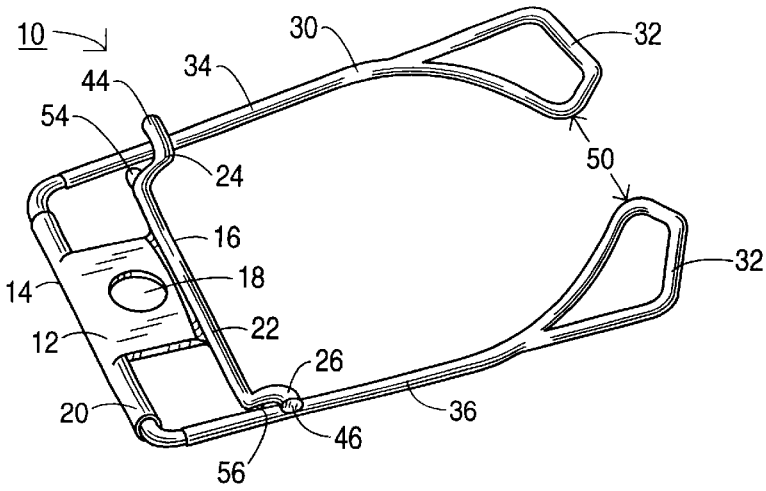
FIG. 1 is a perspective top view of one embodiment of the support of the present invention.
Figure 2:
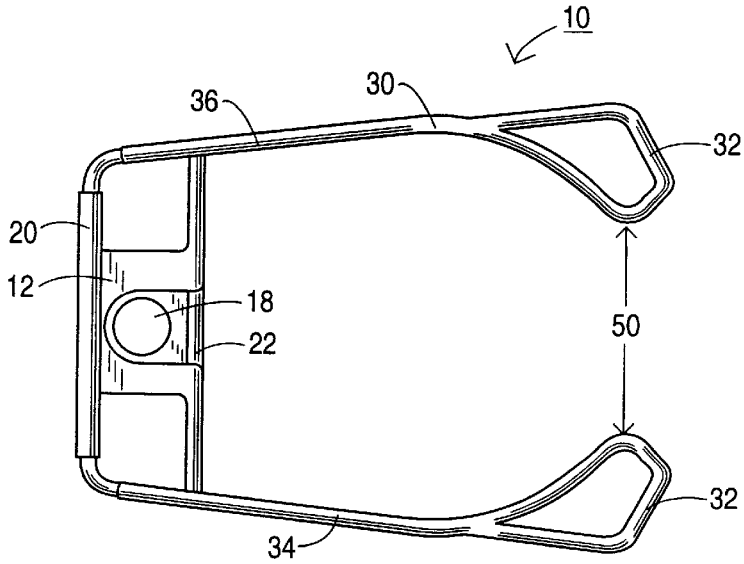
FIG. 2 is a bottom plan view of one embodiment of the support of the present invention.
Figure 3:
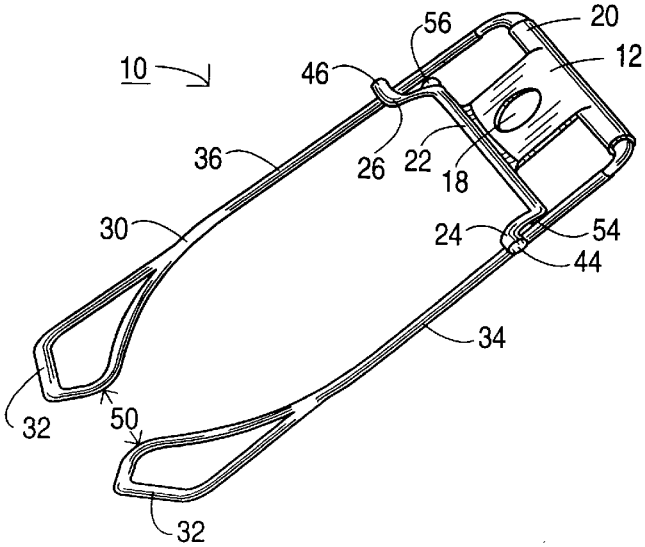
FIG. 3 is a side view of one embodiment of the support of the present invention.

Referring now to the drawings, FIGS. 1, 2, and 3 depict a support 10 constructed in accordance with the present invention. Substantially rectangular mounting plate 12 is formed with a substantially centralized opening 18. The plate 12 is formed with a hollow barrel 20 along its bottom edge 14. Parallel to the tube 20, on the opposite edge 16 of the plate 12, a rod 22 is formed. Rod 22 has two ends 24, 26. Each end 24, 26 has two bends formed therein to curve the rod ends upwardly and outwardly, respectively.

Frame 30 preferably is formed by first threading a length of material through the hollow barrel 20. Preferably, the material is a resilient wire made of metal, such as steel; however, polymers such as polyethylene may be used. The inner diameter of hollow barrel 20 is larger than the outer diameter of the frame material 30. Upon threading the material through the hollow barrel, the material is bent symmetrically into a U-shaped frame 30, with the barrel 20 cooperating to form the bottom of the U. Then, the ends of the material are convoluted and welded forming a substantially planar foot 32 at each end. The frame, thus, has rotatable arms 34, 36 that rotate in co-planar fashion about the hollow barrel 20. Various details of design and construction may be (changed. For example, a frame of non-unitary construction with separate rotatable arms may be formed by appropriately mounting separate arms to the bottom edge of the mounting plate 12.

The rod 22 is longer than the width between the arms 34, 36 so as to form a stop 44, 46 on each side of the frame. The frame is formed with ribs 54, 56 on each arm 34, 36. The position of the rib coincides with the position where the stops 44, 46 touch the frame arms 34, 36. The ribs 54, 46 communicate with the stops 44, 46 to hold the frame 30 releasably secure to the mounting plate 12 in a substantially planar position.

Figure 4:
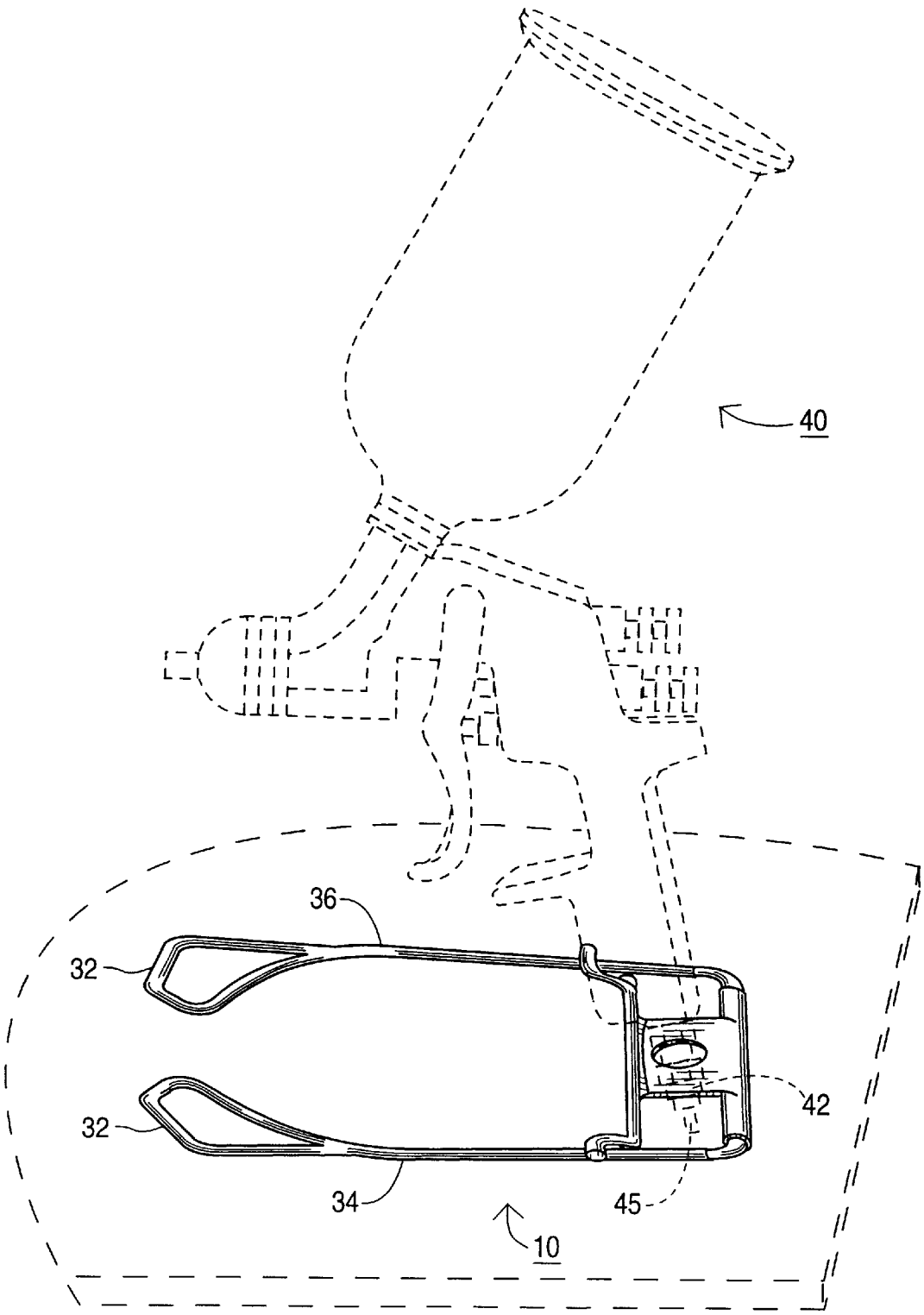
FIG. 4 is a top perspective view of the present invention used as to stand a gravity fed paint gun on a substantially horizontal surface.
Figure 5:
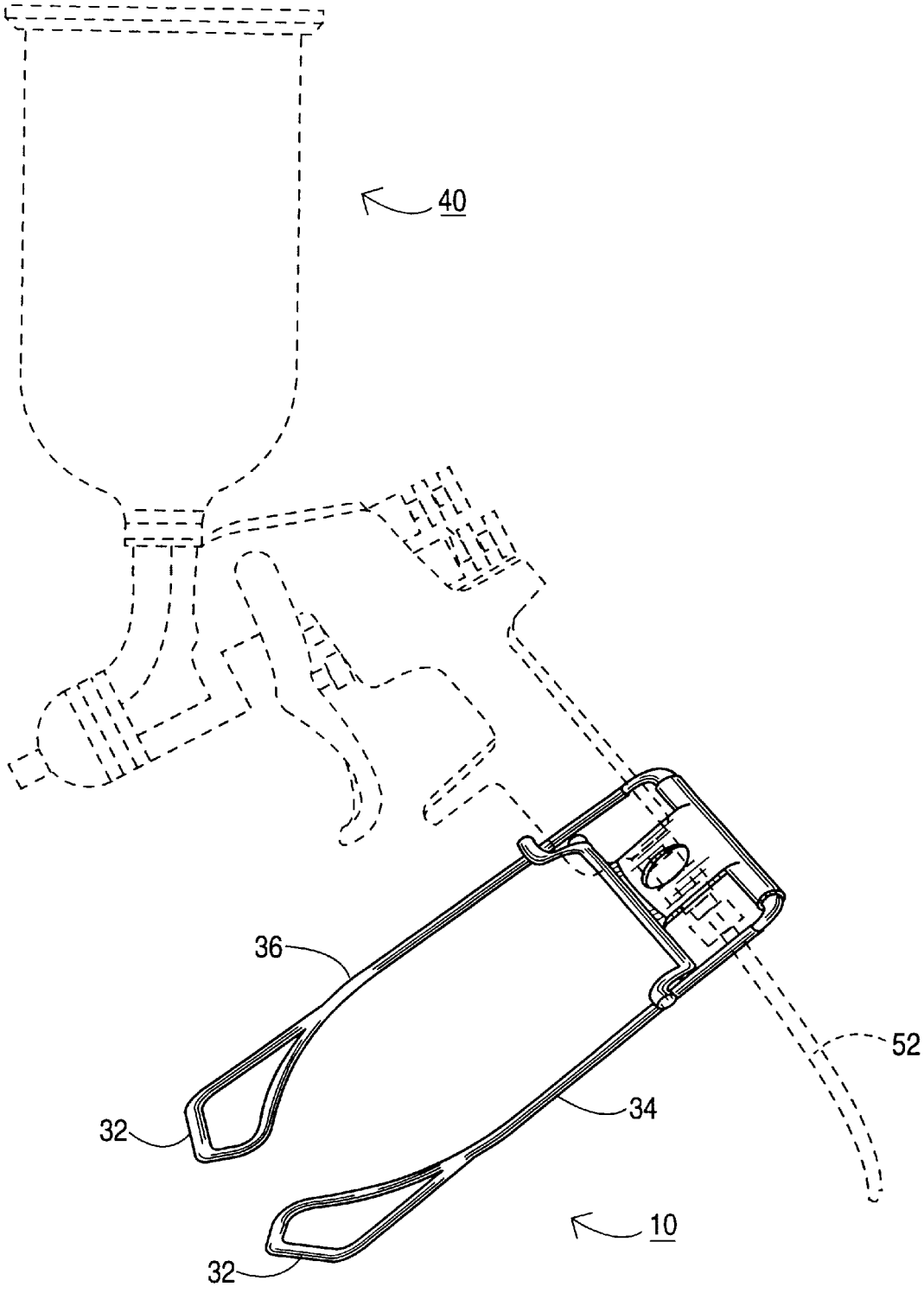
FIG. 5 is an enlarged side view showing a paint gun mounted to the present invention.

FIGS. 4 and 5 show a gravity fed paint gun 40 used with the present invention. The gun 40 is secured to the mounting plate 12. A user places the paint gun's air hose inlet 42 through the centralized opening 18 and thereafter screws an air hose connector 45 to the inlet 42. Thus, the gun 40 is securely mounted to the support 10.

Figure 6:
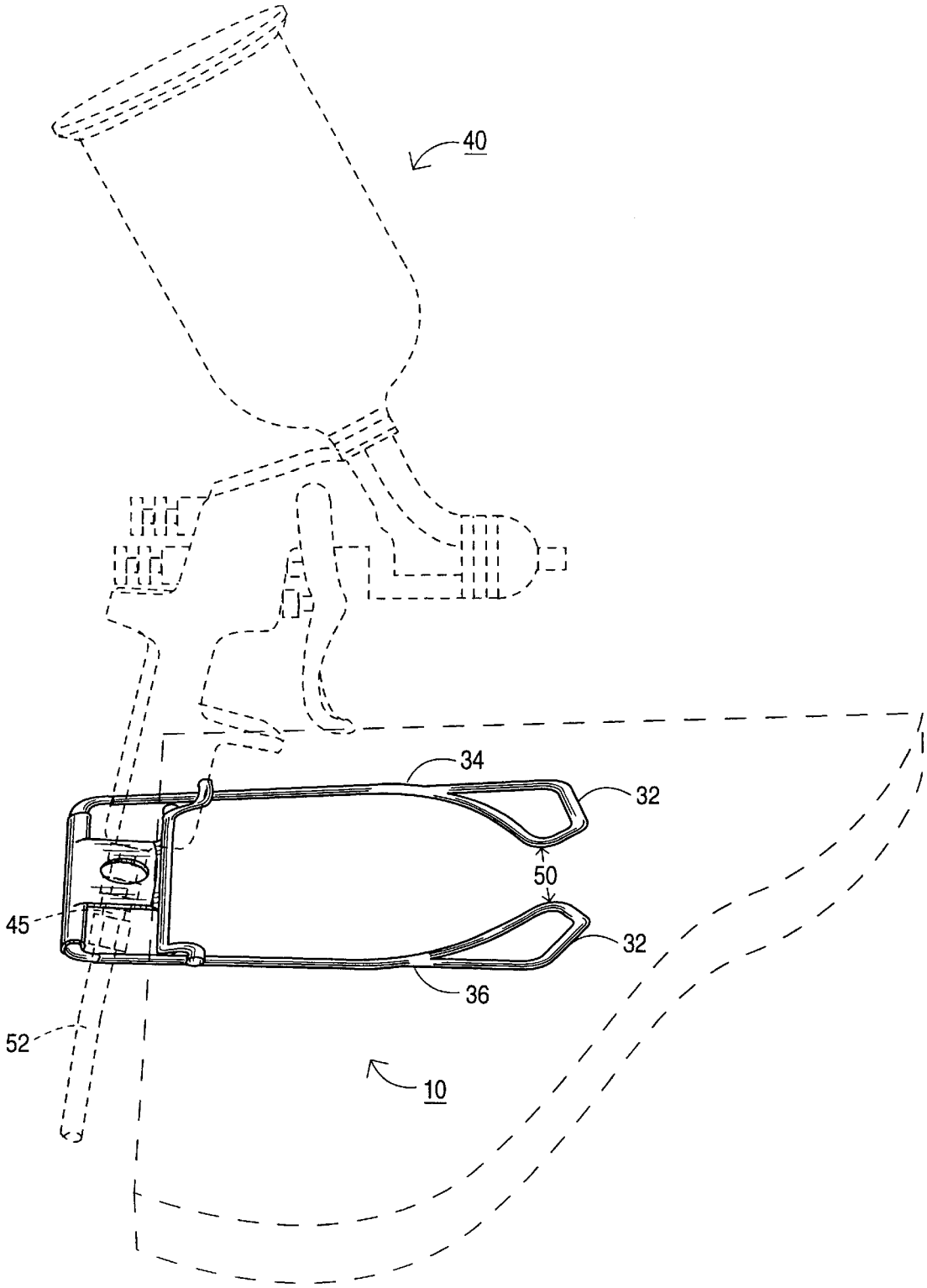
FIG. 6 is a perspective view of the present invention supporting a paint gun with attached air hose on a substantially horizontal surface.

By securing the arms 34, 36 to the rod 22 using the ribs 54, 56 and stops 44, 46, the gun 40 may be safely placed on any substantially horizontal surface, as shown in FIG. 6. Thus, the support 10 allows the paint gun 40 to be stored in this preferable upright position. Further, reloading and mixing may occur without the inconvenience of using a stand permanently mounted to a wall or workbench.

As also shown in FIG. 6, the frame 30 is formed leaving a passage 50 between the feet 32. The width of this passage preferably must be large enough so an air hose 52 may pass through it unobstructed. Thus, as seen in FIG. 6, once an air hose 52 is attached to the connector 45, the support allows a user to place the gun on the edge of any workbench, table or other substantially horizontal surface. The hose 52 need not be disconnected; rather, may conveniently remain attached to the gun 40. Thus, during momentary idle periods the hose remains connected and the user may resume painting without the inconvenience of reconnecting the hose.

Figure 7:
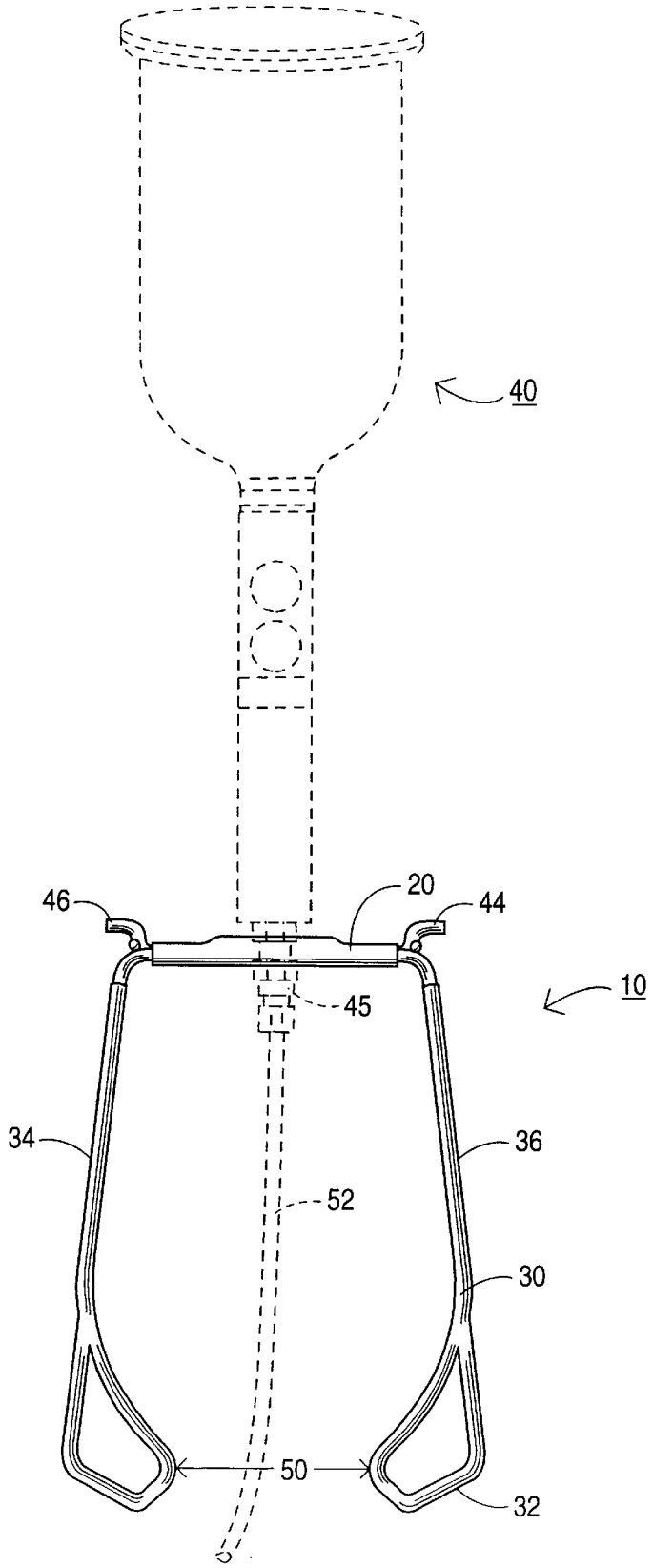
FIG. 7 is a rear view of the present invention attached to a paint gun connected to an air hose.
Figure 8:
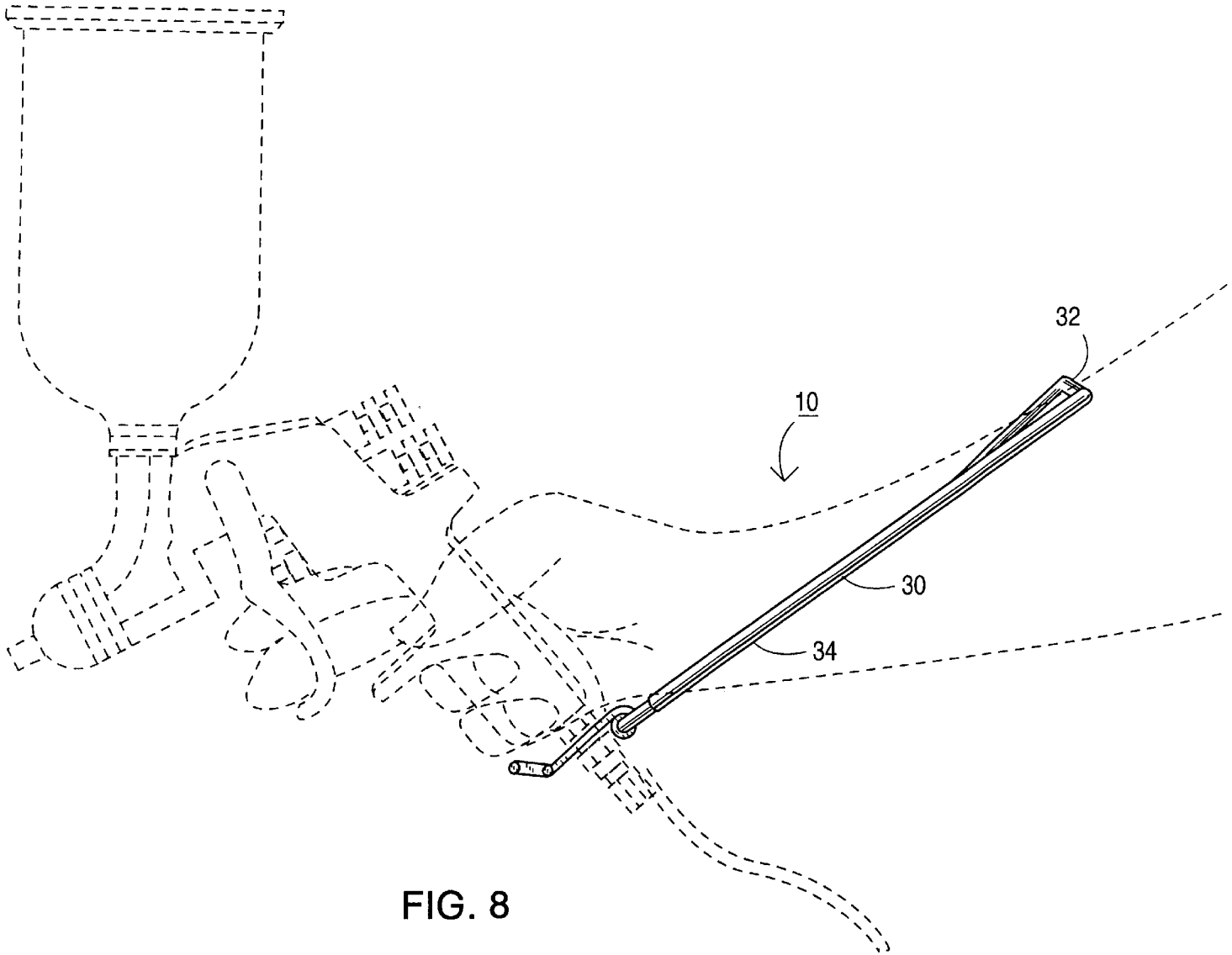
FIG. 8 is a side view of the present invention resting upon a user's forearm during use of the paint gun

As seen in FIGS. 7 and 8, the passage 50 allows the frame 30 to be rotated about the hollow barrel 20 without obstruction by the hose 52. Thus, the frame 30 may be released from the stops 44, 46 and rotated to a position approximately 180° from that secured position. A user, as in FIG. 8, may place his hand through the frame 30 to grasp the air gun's grip and trigger. The user may comfortably paint while the frame 30 rests upon his forearm. Further, it is preferred that the frame 30 is contoured to the general shape of a forearm for grater comfort. Further, the frame 30 may be rotated to a position approximately 270° from the secured position. Preferably, the passage 50 is formed at an appropriate width such that the gun 40 can be wedged into the passage 50 to hold the frame 30 in an upright position.

Figure 9:
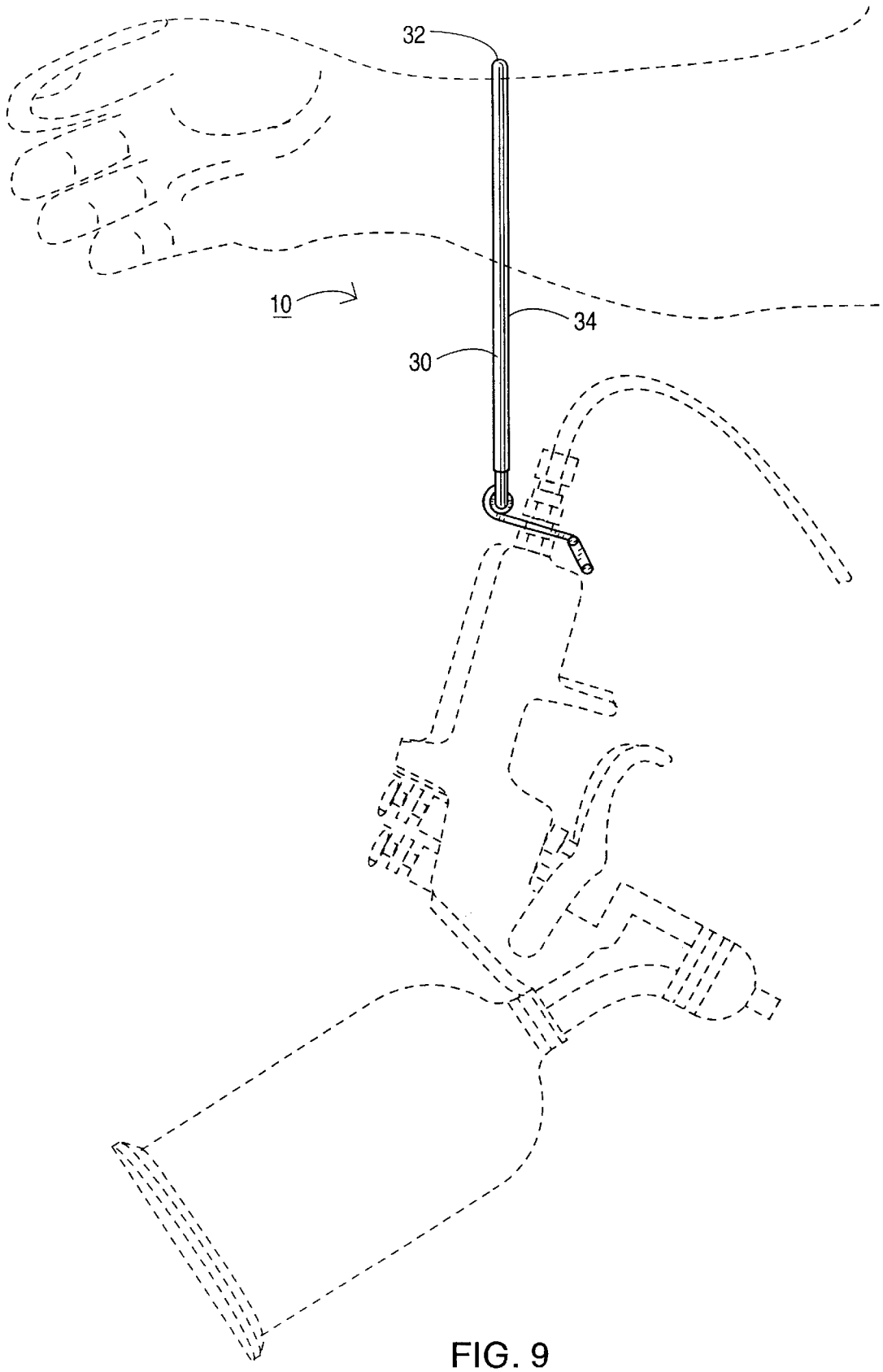
FIG. 9 is a side view of the present invention supporting an air gun from a user's arm.

FIG. 9 depicts another feature of the present invention. On occasion the user may drop the paint gun. This potentially causes damage to the gun, spills and injury. As shown in FIG. 9, should the user drop the gun, the frame 30 supports the gun from the user's forearm, preventing these potential misfortunes. To accomplish this feature, the opening 50 serves as a retainer and is small enough to allow the frame 30 to catch on the user's arm. Other forms of retainers, such as a single leg, strap, ring or hook could be used as well. While preferably the retainer is multi-functional and integral to and with the attachment, this is not essential.

It is to be understood that the above detailed description of the embodiment is provided for example only and should not be construed as constituting any limitation of the invention. Modifications will be obvious to those skilled in the art, and all modifications that do not depart from the spirit of the invention are intended to be included within the scope of the appended claims.

I claim:

1. A spray gun attachment comprising:

a mounting element capable of being mounted to a hand-held gravity fed spray gun without interfering with operation of the spray gun; and a retainer attached to the mounting element, the mounting element comprising a mounting plate having an opening capable of receiving an air hose inlet of the spray gun, and designed to secure the spray gun to a user's arm in the event of dropping of the spray gun.

2. A support for use in connection with gravity fed spray guns comprising:

a substantially rectangular mounting plate;

at least one arm rotatably mounted to the plate, the at least one arm extending from the mounting plate, the at least one arm having a foot located opposite from the mounting plate; and an opening within the mounting plate for connecting the gravity fed spray gun to an air hose thereby mounting the spray gun to the support.

3. The support of claim 2 further comprising:

a rod connected to the mounting plate perpendicular to the at least one arm and extending in length beyond the at least one arm.

4. The support of claim 3 further comprising:

a rib formed on the at least one arm located such that the rib and the rod communicate to releasably secure the at least one arm and the mounting plate in a substantially planar position.

5. The support of claim 2 wherein the foot is substantially planar with the at least one arm and forms a passage with the passage being at least as large as the outer diameter of the air hose.

6. The support of claim 5 wherein the passage is at least as large as the width of the gravity fed spray gun such that when the gun is wedged into the passage the at least one arm is releasably secured in an upright position substantially parallel with the spray gun's handle.

7. The support of claim 6 wherein the opening is large enough to fit over an air hose inlet of a gravity fed paint gun yet small enough to hold the mounting plate secured to the gun when an air hose connector is screwed onto the air hose inlet.

8. The support of claim 6 wherein upon securing the mounting plate to the gun the at least one arm is rotatable about approximately 270°.

9. The support of claim 6 wherein upon securing the mounting plate to the gun the at least one arm is rotatable about the mounting plate into at least three predetermined positions:

a down position wherein the at least one arm is substantially planar with the mounting plate and the at least one arm acts as a stand for the gun;

an intermediate position wherein the at least one arm rests upon a user's wrist while the user operates the gun; and an up position wherein the gun is wedged into the passage and the at least one arm is substantially parallel with the gun handle.

10. A support for use in connection with gravity fed spray guns comprising:

a substantially planar frame having:

a bottom segment;

two substantially parallel side arms each with two ends, each of the first ends connected to the bottom segment;

a foot formed at each other end of the side arms with a passage between the feet;

a substantially rectangular mounting plate having:

a substantially centralized opening for an air hose connection;

a hollow tube formed along one side for housing the bottom segment of the frame the tube having a larger inner diameter than the outer diameter of the bottom segment;

a rod formed along a substantially parallel side from the hollow tube the rod extending beyond the width between the two substantially parallel side arms to form a stop on each end of the rod; and a rib formed on each substantially parallel side arm located such that the rib and the stop communicate to releasably secure the frame in a substantially planar relation with the mounting plate, whereby a gravity hose connector is placed through the centralized opening and subsequently connected to the gravity fed spray gun thereby securing the gun to the mounting plate which thereafter may be placed in an upright position by releasably securing the substantially parallel side arms with the stops and placing the frame on a substantially horizontal surface.

11. The support of claim 10 wherein the passage between the feet is larger than the outer diameter of an air hose.

12. The support of claim 10 wherein the passage between the feet is substantially the same as the width of the spray gun above the grip whereby the spray gun may be wedged into the passage to releasably secure the frame to the gun.

* * * * *

UNITED STATES PATENT AND TRADEMARK OFFICE

CERTIFICATE OF CORRECTION

PATENT NO : 6,070,809

DATED : June 6, 2000

INVENTOR(S): Charles Keith Price

It is certified that error appears in the above-identified patent and that said Letters Patent are hereby corrected as shown below:

Column 1, line 7, the word "led" should read --fed--. Column 2, line 46, the open parenthetical should be deleted.

Signed and Sealed this

Third Day of April, 2001

*Attest:*

Nicholas P. Godici

NICHOLAS P. GODICI

*Attesting Officer*

*Acting Director of the United States Patent and Trademark Office*